US005578150A

United States Patent [19]

Suzuki et al.

[11] Patent Number: 5,578,150

[45] Date of Patent: Nov. 26, 1996

[54] HEAT TREATMENT PROCESS FOR WIRE RODS

[75] Inventors: Takefumi Suzuki; Shigekatsu Ozaki, both of Futtsu, Japan

[73] Assignee: Nippon Steel Corporation, Tokyo, Japan

[21] Appl. No.: 466,964

[22] Filed: Jun. 6, 1995

Related U.S. Application Data

[63] Continuation of Ser. No. 95,207, Jul. 23, 1993, abandoned.

[30] Foreign Application Priority Data

Jul. 28, 1992 [JP] Japan ..... 4-201123

[51] Int. Cl.[6] ..... E21D 1/00; C21D 1/607

[52] U.S. Cl. ..... 148/595; 148/596; 148/600

[58] Field of Search ..... 148/595, 596, 148/600; 266/106, 112, 113

[56] References Cited

U.S. PATENT DOCUMENTS

| | | | |
|---|---|---|---|
| 3,340,109 | 9/1967 | Keough | 148/153 |
| 3,615,926 | 10/1971 | Taylor | 148/143 |
| 3,785,878 | 1/1974 | Economopoulos | 148/596 |
| 4,314,860 | 2/1982 | Tominaga | 148/596 |

FOREIGN PATENT DOCUMENTS

| | | | |
|---|---|---|---|
| 2015665 | 10/1971 | Germany | 148/596 |
| 2435831 | 2/1976 | Germany . | |
| 4035155 | 9/1991 | Germany . | |
| 56-38426 | 4/1981 | Japan . | |
| 56-102524 | 8/1981 | Japan . | |
| 63-105933 | 5/1988 | Japan . | |
| 2062692 | 5/1981 | United Kingdom . | |

*Primary Examiner*—Sikyin Ip

*Attorney, Agent, or Firm*—Wenderoth, Lind & Ponack

[57] ABSTRACT

A conveyor moves forward an unconcentrically spiralled loose coil of steel wire rod having a temperature not lower than $Ar_3$ into a retention bath of molten salt for heat treatment. Just before entering the retention bath, the coil is quenched by spraying a solution of molten salt kept at a temperature between 400° and 600° C. and not higher than the temperature of the retention bath either from above and below or from only above the coil. Then, the quenched coil is retained in the retention bath of molten salt kept at a temperature between 400° and 600° C., thereby causing pearlite transformation and forming a fine pearlite structure in the wire rod.

8 Claims, 2 Drawing Sheets

HEAT TREATMENT PROCESS FOR WIRE RODS

This application is a continuation of now abandoned Ser. No. 08/095,207 filed Jul. 23, 1993, abandoned.

BACKGROUND

This invention relates to a heat treatment process for steel wire rods, and, more particularly, to a process for directly heat treating steel wire rods by utilizing the heat produced during the finish rolling of steel wire rods.

Heat treatment is necessary to impart high strength and toughness to hot-rolled hard-steel wire rods. Lead patenting is a common heat treatment process conventionally employed in the production of high-strength rods. In addition to this, simpler direct heat treatment processes utilizing the sensible heat (800° to 1000° C.) conserved in hot-rolled rods have been developed. For example, Japanese Provisional Patent Publications Nos. 38426 of 1981 and 102524 of 1981 proposed processes to dip as-rolled rods directly in a solution of salt.

A process disclosed in Japanese Provisional Patent Publication No. 38426 of 1981 uses a low-temperature bath of molten salt 14 and a high-temperature bath of molten salt 15, as shown in FIG. 3. A coil of steel wire rod 1 falling onto a roller conveyor 3 from a laying head 2 of a take-up reel moves forward in an unconcentric spiral. The moving rod is first cooled in the low-temperature bath of molten salt 14 in which a sorbite structure is formed and then in the high-temperature bath of molten salt 15 where untransformed austenite is completely transformed into sorbite. This process requires both a low-temperature bath for quenching and a high-temperature bath for retention, as one bath cannot provide adequate cooling.

Another process disclosed in Japanese Provisional Patent Publication No. 102524 of 1981 obtains a fine structure of pearlite by uniformly cooling wire rods in a bath of molten salt whose rate of heat transfer is increased by agitating with air or other gases satisfying specific requirements.

Though the processes employing two or one bath of molten salt just described produce wire rods having high strength and toughness comparable to those obtained by lead patenting, they involve the following new problems.

In the former process, undercooling of the surface and subsurface area to a temperature considerably lower than that desirable for transformation (which is substantially equal to the temperature of the high-temperature bath for retention) produces bainite. The use of two baths, one for quenching (at approximately 400° C.) and one for retention (at approximately 550° C.), necessitates troublesome temperature control of the individual baths as well as higher equipment investment and running cost. The latter process also gives rise to a problem of bainite formation resulting from the undercooling of the surface.

SUMMARY

The object of this invention is to provide a heat treatment process to produce steel wire rods having high strength and toughness at low cost with one bath of molten salt while solving the problems encountered by the conventional processes as described before.

A heat treatment process for steel wire rods to achieve the above object of this invention comprises the steps of forming an unconcentrically spiralled loose coil of steel wire rod just rolled and having a temperature not lower than $Ar_3$ on a conveyor by means of a take-up reel, quenching the wire rod being conveyed forward by spraying a solution of molten salt at a temperature between 400° and 600° C. and not higher than the temperature of a bath of molten salt for retention either from above and below or from only above and subsequently retaining the quenched wire rod in said retention bath of molten salt kept at a temperature between 400° and 600° C., thereby producing a fine pearlite structure through pearlite transformation.

Another heat treatment process of this invention comprises the steps of introducing a coil of wire rod into a bath of molten salt and quenching the wire rod immediately after the introduction into the bath by spraying a solution of molten salt at 400° and 600° C. either from above and below or from only above the coil in the bath.

In the above processes, a cooled solution of molten salt may be sprayed to the coil of wire rod, or retention may be effected by conveying the coil of wire rod placed in a bath of molten salt.

Spraying a solution of molten salt onto the coil of wire rod assures a high cooling efficiency and permits attaining the desired goal with only one bath of molten salt.

DRAWINGS

Figure 5:
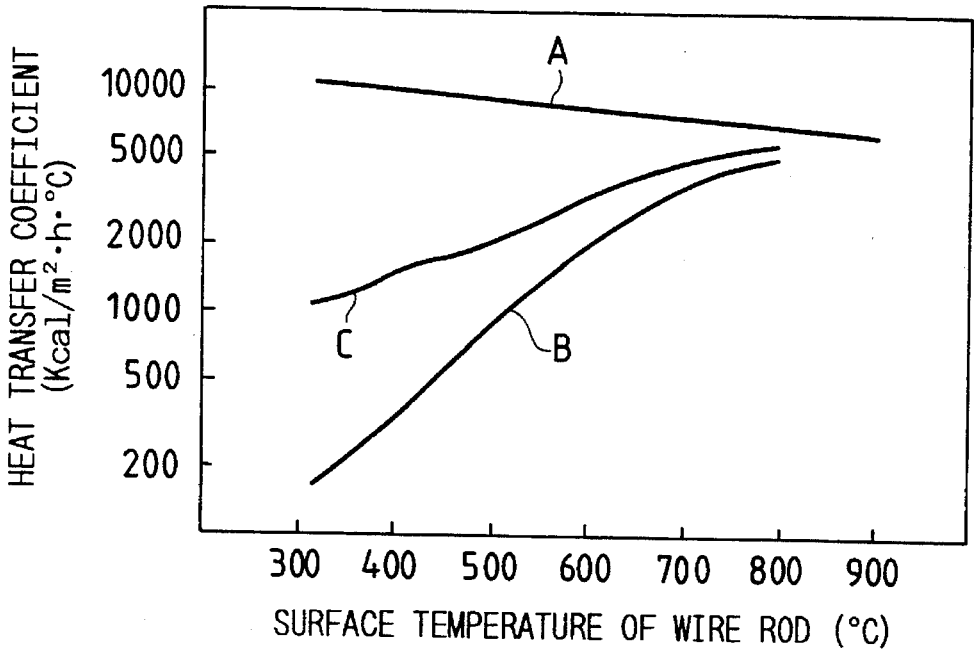

FIG. 5 graphically compares the relationships of the surface temperature to the heat transfer coefficient in a process of this invention and a process tested for the purpose of comparison.

DESCRIPTION

Figure 4:
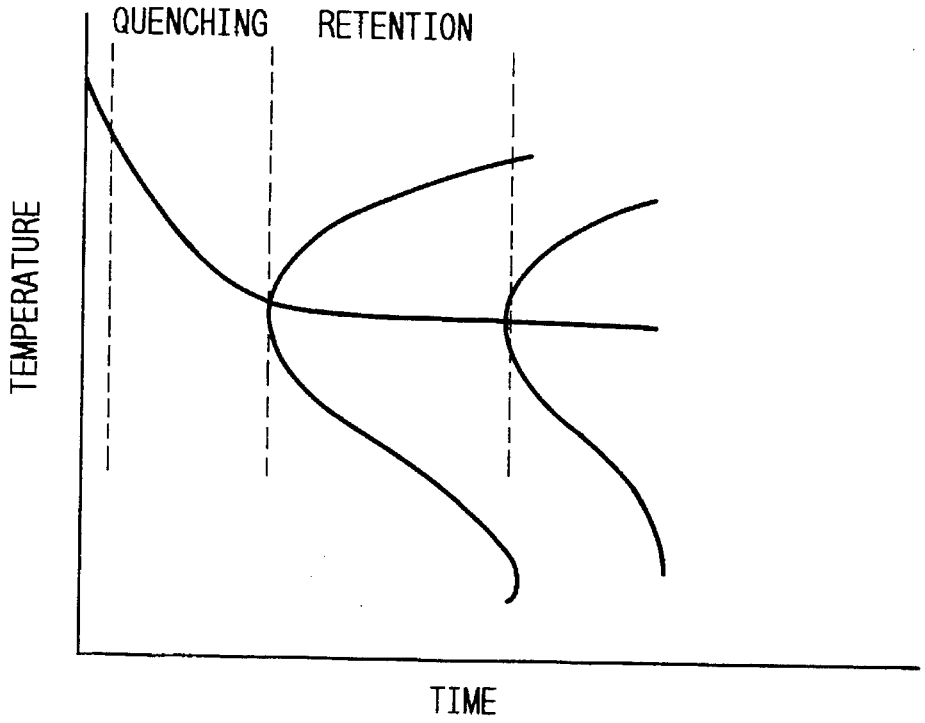
FIG. 4 is a graphical representation of a TTT curve and a cooling curve.

To obtain wire rods having a fine pearlite structure, pearlite transformation must be caused by quenching the wire rod from near 1000° C. and retaining the quenched rod at a given temperature. For example, the wire rod must be quenched to a temperature at the nose of the TTT curve shown in FIG. 4 and then retained at a given temperature (usually approximately 550° C.). If only one bath is used in which the temperature is kept at the quenching temperature that is lower than the retention temperature, the desired retention temperature cannot be maintained as a result of undercooling. Conversely, quenching is impractical if the bath temperature is kept at the retention temperature. This is the reason why two baths have conventionally been employed to carry out quenching and retention separately.

This invention has obviated the above difficulty by quenching the hot wire rod fresh from the rolling process by spraying a solution of molten salt either above or in the entry end of a bath of molten salt, thereby increasing the heat transfer coefficient of the quenched part of the rod by a factor of two to three over the conventional level. The heat flux in the cooled steel is proportional to $h \times \Delta T$ (where h= heat transfer coefficient and $\Delta T$= temperature difference between the cooling medium and the surface of the cooled steel). When the rod temperature is high, accordingly, $\Delta T$ is large and the cooling rate is high. If the rod temperature drops, however, both ΔT and the cooling rate decrease. The spray of a solution of molten salt employed in the process of this invention maintains a high heat transfer coefficient in the wire rod even when its temperature drops, as indicated by curve A in FIG. 5. The two to three times higher heat transfer coefficient than conventional thus obtained permits maintaining a high cooling rate even when the rod temperature drops. In FIG. 5, curves B and C show the heat transfer coefficients in the conventional dip and gas-agitation processes.

Details of a heat treatment process of this invention employing a single bath of molten salt will be described by reference to the accompanying drawings.

Figure 1:
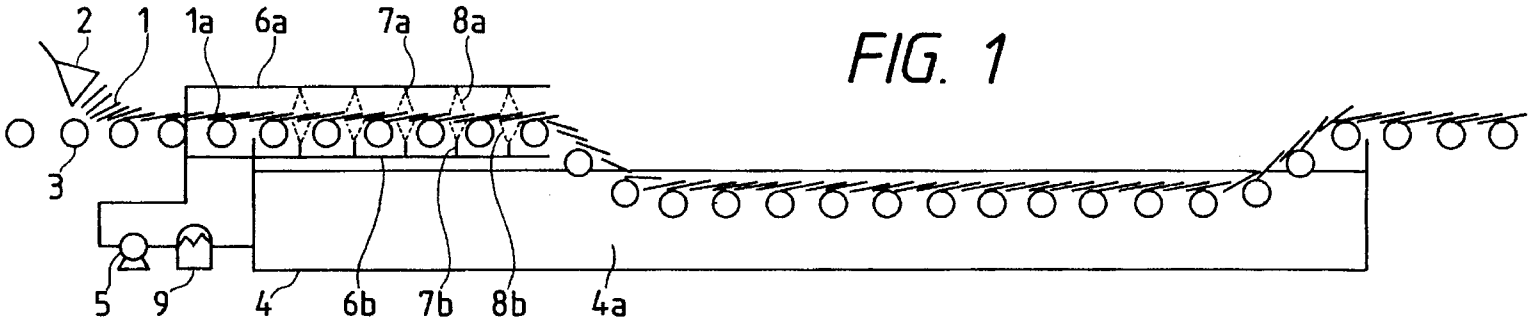
FIG. 1 is a overall schematic view of an apparatus for implementing a process of this invention.

FIG. 1 shows an apparatus for implementing a heat treatment process of this invention. Reference numeral 1 designates wire rod, 2 a laying head, 3 a roller conveyor, and 4 a bath of molten salt 4*a* into which the wire rod 1 is dipped. In this apparatus, the top surface of the roller conveyor 3 is kept above the surface of the bath 4 over a given distance from the entry end thereof. In this elevated region, the wire rod 1 on the conveyor 3 is forcibly cooled by a solution of molten salt 8*a*, 8*b* sprayed from above and below (or only from above). This spray system comprises a series of top nozzles 7*a* and bottom nozzles 7*b* disposed in the direction of rod travel, with a molten salt pump 5, a top nozzle header 6*a* and a bottom nozzle header 6*b* connected thereto. Reference numeral 9 denotes a molten salt cooler interposed between the pump 5 and bath 4 to suck the warmed solution of molten salt 4*a* from the bath 4, cool the solution back to the predetermined bath temperature and return the cooled solution to the nozzle headers 6*a*, 6*b*.

In this apparatus, the wire rod 1 falling onto the roller conveyor 3 from the laying head 2 of a take-up reel moves forward in a loose unconcentrically spiraled coil 1*a*. On entering the space above the salt bath 4, but not in the bath 4 itself yet, the wire rod 1 on the conveyor 3 over a given distance from the entry end thereof is quenched by a solution of molten salt 8*a*, 8*b* directly sprayed from the nozzles 7*a* and 7*b* above and below. The wire rod 1 thus quenched then enters the salt bath 4 itself for retention and then leaves the bath after a given period of time to continue its travel into the following process.

Figure 2:
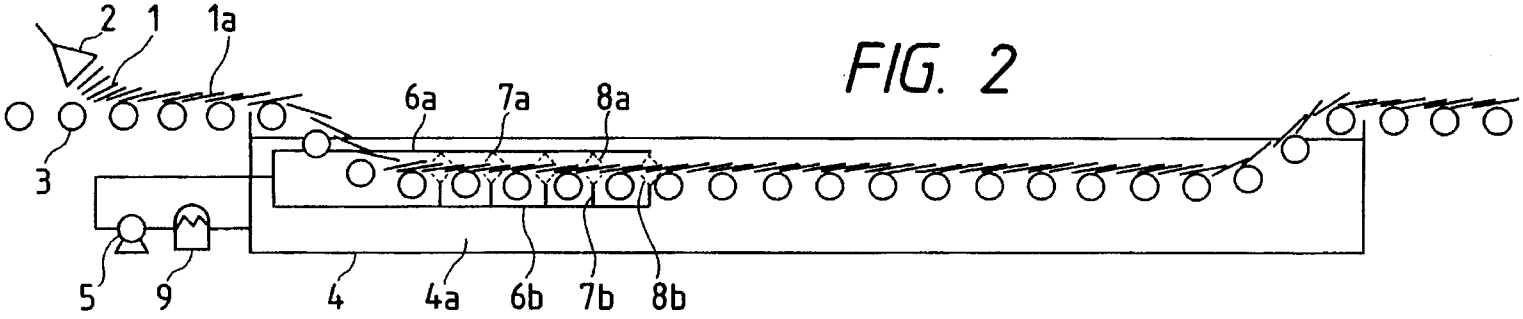
FIG. 2 is an overall schematic view of another apparatus for implementing a process of this invention.
Figure 3:
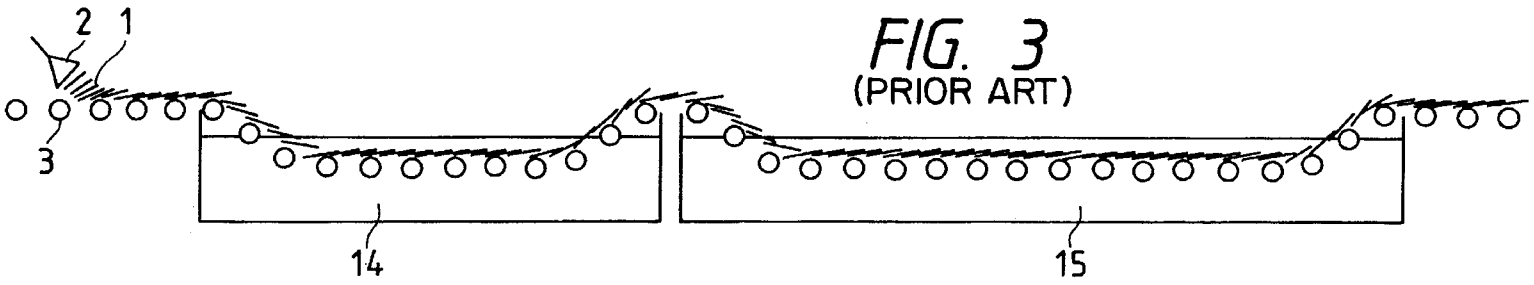
FIG. 3 (PRIOR ART)
FIG. 3 is an overall schematic view of an apparatus for implementing a conventional dual-salt-bath process.

FIG. 2 shows another apparatus to implement the heat treatment process of this invention, in which molten salt spraying is applied in the salt bath 4. Unlike the apparatus shown in FIG. 1, a solution of molten salt 8*a*, 8*b* is sprayed from above and below the wire rod not outside but inside the bath 4 of molten salt 4*a*. Therefore, the top surfaces of the rollers of the conveyor 3 are kept below the bath surface throughout the entire length of the bath 4. Like reference characters denote parts similar to those in FIG. 1.

The cooling operation and function of the apparatus shown in FIG. 2 are essentially similar to those of the apparatus shown in FIG. 1, with the exception of a few minor differences. For example, the apparatus in FIG. 2 dispenses with the need for means to be taken against the mist resulting from spraying. On the other hand, the tip of the nozzles disposed inside the bath must be brought closer (not more than approximately 300 mm away) to the wire rod.

The wire rod delivered to the heat treatment process of this invention, whether on the apparatus shown in FIG. 1 or the one in FIG. 2, has been finish-rolled at a temperature at least not lower than $Ar_3$ (usually, finish-rolled hard-steel wire rod has a sensible heat of 800° to 1000° C.). To obtain a fine pearlite structure, such as rolled wire rod must be quenched to a temperature between 400° and 600° C. and, then, retained in the same temperature range in a bath of molten salt. The temperature of the salt bath is kept either equal to the lower limit of the pearlite transformation temperature which, though it varies with the composition of steel, is approximately 500° to 600° C. or in a lower range of 400° to 600 ° C. The solution of molten salt sprayed is kept between 400° and 600° C. and not higher than the above temperature of the retention salt bath. The temperature difference between the salt spray and retention bath should preferably be kept within 40° C. because undercooling results if the temperature of the salt spray is much lower than that of the retention bath.

With the heat treating temperature ranges thus preset, pearlite transformation begins in the wire rod quenched in the bath of molten salt in which the quenched rod is subsequently retained for a given period of time until pearlite transformation is complete, whereupon a fine pearlite structure is formed in the wire rod.

The salt spraying devices should not be limited to those shown in FIGS. 1 and 2. Other conventional spraying devices may also be used if they function similarly. Also, the travel of the wire rod in the salt bath may be suspended for a given period of time to achieve the desired retention.

Now an example of wire rod heat treated by the process of this invention is described below, together with two examples of wire rod heat treated by a conventional process involving gas agitation.

The specimens were taken from wire rods having a diameter of 8 mm and a chemical composition shown in Table 1. The specimens were heat treated so that transformation occurs at temperatures near the targeted temperature of 552° C. at any point of the cross section. The molten salt used in the heat treatment consisted of 50% of $NaNO_3$ and 50% $KNO_3$.

Table 2 shows the cooling conditions employed. Conventional process 1 tested for comparison is the most effective one among the conventional processes. To achieve rapid cooling during the initial stage, the temperature of the first bath was kept considerably lower than the targeted transformation temperature. Conventional process 2 for comparison, like conventional process 1 for comparison, also employed cooling with agitation. However, process 2 for comparison used only one bath whose temperature was kept substantially equal to the targeted transformation temperature to prevent the undercooling of the surface of the specimen.

Table 3 shows the mean transformation temperatures at different selected points in the cross section of the specimens. In the surface of the specimen heat treated by conventional process 1 for comparison, transformation took place at a temperature lower than the targeted temperature because of the low temperature of the first bath, thus producing supercooled bainite in that part. On the other hand, the temperatures at the different selected points of the specimen heat treated by conventional process 2 did not reach the targeted transformation temperature while scattering considerably because of inadequate cooling. By contrast, the specimen heat treated by the process of this invention exhibited a uniformly transformed structure, with the temperatures at the different selected points therein varying little from each other and differing little from the targeted transformation temperature.

TABLE 1

| Chemical Composition of Specimens | | | | | |
|---|---|---|---|---|---|
| C | Si | Mn | P | S | Al |
| 0.842% | 0.236% | 0.76% | 0.013% | 0.007% | 0.025% |

TABLE 2

| | Cooling Conditions | | | |
|---|---|---|---|---|
| | Cooling Starting | Salt Bath Temperature (°C.) | | |
| Process | Temperature (°C.) | Bath No. 1 | Bath No. 2 | Spraying Conditions |
| Process of This Invention (One Bath) | 850 | 550 | — | Flow density of salt spray: 2000 $l/m^2 \cdot$ min. |
| Process 1 for Comparison, with Gas Agitation (Two Baths) | 850 | 480 | 550 | Agitated with 500 $l/m^2 \cdot$ min. of gas |
| Process 2 for Comparison, with Gas Agitation (One Bath) | 850 | 550 | — | Agitated with 500 $l/m^2 \cdot$ min. of gas |

TABLE 3

| | Transformation Temperatures | | | |
|---|---|---|---|---|
| | Distance from Surface (mm) | | | |
| Process | 0.1 | 1.0 | 2.0 | 4.0 |
| Process of This Invention | 550 | 551 | 552 | 554 |
| Process 1 for Comparison, with Gas Agitation (Two Baths) | 520 | 534 | 542 | 555 |
| Process 2 for Comparison, with Gas Agitation (One Bath) | 612 | 623 | 634 | 642 |

As described above, the heat treatment process of this invention provides adequate cooling with one quenching bath. As such, the process of this invention can be used to great advantage in the production of high-quality steel wire rods with much less equipment investment and running cost.

What is claimed is:

1. A heat treatment process for steel wire rod comprising the steps of:

forming an unconcentrically spiralled loose coil of steel wire rod just rolled and having a temperature not lower than $Ar_3$ on a conveyor by means of a take-up reel;

spraying the wire rod being conveyed forward in the unconcentrically spiralled loose coil with a solution of molten salt at a temperature between 400° and 600° C. and not higher than a temperature of a bath of molten salt for retention either from above and below or from only above, to quench the wire rod to a temperature between 400° and 600° C.; and subsequently introducing and retaining the quenched wire rod, in the unconcentrically spiralled loose coil, in said retention bath of molten salt kept at a temperature between 400° and 600° C., thereby producing a fine pearlite structure in the wire rod through pearlite transformation.

2. A heat treatment process for steel wire rod according to claim 1, in which the temperature difference between the sprayed solution of molten salt and the retention bath of molten salt is kept within 40° C.

3. A heat treatment process for steel wire rod according to claim 1, in which a cooled solution of molten salt is sprayed onto the coil of steel wire rod.

4. A heat treatment process for steel wire rod according to claim 1, in which the coil of steel wire rod held in a bath of molten salt is moved forward by means of a conveyor.

5. A heat treatment process for steel wire rod comprising the steps of:

forming an unconcentrically spiralled loose coil of steel wire rod just rolled and having a temperature not lower than $Ar_3$ on a conveyor by means of a take-up reel;

introducing the coil of wire rod into a bath of molten salt for retention and spraying the wire rod immediately after the introduction into the bath with a solution of molten salt at 400° and 600° C. either from above and below or from only above the unconcentrically spiralled loose coil in the bath, to quench the wire rod to a temperature between 400° and 600° C.; and subsequently retaining the quenched wire rod, in the unconcentrically spiralled loose coil, in said retention bath of molten salt kept at a temperature between 400° and 600° C., thereby producing a fine pearlite structure in the wire rod through pearlite transformation.

6. A heat treatment process for steel wire rod according to claim 5, in which the temperature difference between the sprayed solution of molten salt and the retention bath of molten salt is kept within 40° C.

7. A heat treatment process for steel wire rod according to claim 5, in which a cooled solution of molten salt is sprayed onto the coil of steel wire rod.

8. A heat treatment process for steel wire rod according to claim 5, in which the coil of steel wire rod held in a bath of molten salt is moved forward by means of a conveyor.

* * * * *